US006058755A

United States Patent [19]

Viegener

[11] Patent Number: 6,058,755

[45] Date of Patent: May 9, 2000

[54] PRESS TOOL FOR NON-DETACHABLY CONNECTING A FITTING AND AN END PORTION OF A METAL PIPE RECEIVED IN THE FITTING

[75] Inventor: Walter Viegener, Attendorn, Germany

[73] Assignee: Franz Viegener II GmbH & Co. KG, Attendorn, Germany

[21] Appl. No.: 09/206,486

[22] Filed: Dec. 7, 1998

[30] Foreign Application Priority Data

Dec. 10, 1997 [DE] Germany ..... 297 21 759 U

[51] Int. Cl.[7] ..... B21D 39/04

[52] U.S. Cl. ..... 72/292; 72/402

[58] Field of Search ..... 72/292, 402; 29/237, 29/432.1

[56] References Cited

U.S. PATENT DOCUMENTS 2,674,966 4/1954 Morris ..... 72/292
2,800,867 7/1957 Smith ..... 72/292
4,464,917 8/1984 Kienhofer ..... 72/402
5,598,732 2/1997 Dischler ..... 72/292

FOREIGN PATENT DOCUMENTS 42 40 427 C1 1/1994 Germany .

*Primary Examiner*—Daniel C. Crane
*Attorney, Agent, or Firm*—Henry M. Feiereisen

[57] ABSTRACT

A press tool for non-detachably connecting through cold deformation a fitting and an end portion of a metal pipe received in a socket of the fitting, includes a wraparound ring for placement over the socket of the fitting, and a machine-operated clamping device. The wraparound ring includes a plurality of hinged links and is open at one closing area between two terminal links which are formed with pockets to form grip points for application of the clamping device. The clamping device has a pair of jaws which terminate in lobed ends for engagement in the pockets of the terminal links. The socket of the fitting has formed interiorly a receiving groove which opens inwardly for receiving at least one holding element which is formed with projections or cutting edges for penetrating the material of the metal pipe during radial cold deformation.

11 Claims, 5 Drawing Sheets

PRESS TOOL FOR NON-DETACHABLY CONNECTING A FITTING AND AN END PORTION OF A METAL PIPE RECEIVED IN THE FITTING

CROSS-REFERENCES TO RELATED APPLICATIONS

This application claims the priority of German Patent Application Serial No. 297 21 759.3, filed Dec. 12, 1997, the subject matter of which is incorporated herein by reference.

BACKGROUND OF THE INVENTION

The present invention generally relates to a press tool for non-detachably connecting through cold deformation a fitting and an end portion of a metal pipe received in a socket of the fitting, and more specifically to a press tool of a type having a wraparound ring which includes a plurality of hinged links for placement over the socket of the fitting, whereby the wraparound ring is open at one closing area between two neighboring links and forms grip points at the closing area for application of a closing device.

Various designs have been developed for press tools to press together a fitting and a pipe end. Reference is made for example to German Pat. No. DE 42 40 427, published Jan. 20, 1994.

A press tool of this type is known for non-detachably connecting pipes of a nominal width over 54 mm with a fitting through cold deformation. The socket of the fitting receives the end of the metal pipe and is formed with a bead that faces inwardly for receiving an O ring. The cold connection is realized by positioning a wraparound ring comprised of hinged links about the bead and the socket adjoining the bead, and applying an electrohydraulically operated closing device to bring together the two links bounding the open closing area. This results in a cold deformation of the bead, of the socket zones adjoining the bead and of the associated regions of the metal pipe. The cross-sectional contour of the socket and the metal pipe in the deformed area is polygonal with arched sides and rounded corners. In order to realize this deformation, significant pressing forces must be applied so that the press tool is complicated and has great dimensions and thus is difficult to handle. This type of press tool is also expensive and therefore was generally leased by users and purchased only on rare occasions.

In metal pipes up to a diameter of 54 mm, the pressed connection between the socket of the fitting and the metallic pipe end is realized by an electrohydraulic press tool, with the press tool provided with a clamping device having two jaws that bound a pressing zone. These jaws are swingably mounted to adapters which extend transversely to the longitudinal axis of the clamping device. The jaws grab around the socket of the fitting in the area of a bead for receiving the sealing element and on both sides of the bead. A force is applied immediately before, on and behind the bead to realize a non-detachable joint. Through cold formation of the bead, the sealing ring is pressed onto the pipe end while indentations spaced about the circumference are formed before and behind the bead for plastically forming the pipe end in the area of the indentations.

SUMMARY OF THE INVENTION

It is thus an object of the present invention to provide an improved press tool, obviating the afore-stated drawbacks.

In particular, it is an object of the present invention to provide an improved press tool which is simple in structure and of small dimensions and yet is applicable in situation where metal pipes have a diameter above 54 mm so that the conventional clamping device, which is fitted directly over the fitting, can no longer be used.

These objects, and others which will become apparent hereinafter, are attained in accordance with the present invention by providing the pipe end receiving socket of the fitting with a pocket which opens inwardly for receiving a holding element formed with projections, claws or a cutting edge, and by providing the links of the wraparound ring, which bound the closing area, with pockets for grip ends of a machine-operated clamping device.

A press tool according to the present invention is of simple construction and realizes a non-detachable connection between fitting and pipe end without application of heat even in the event these components exhibit oversized diameters, through cold deformation of the socket of the fitting in the area of the sealing element and the holding element and through penetration of the holding element into the material of the metal pipe to effect a positive fit.

According to another feature of the present invention, the clamping device has two interacting jaws which are rotatable about pivots extending parallel to one another in symmetry to a longitudinal center plane. The jaws are preferably formed in one piece with grip ends for cooperation with the end links adjacent the closing gap. The grip ends may be formed as arched lobes pointing toward the center plane for engagement in pockets of the end links which pockets have a complementary arched inner contour and smooth side surfaces. The arched inner contour of the pockets of the end links preferably terminates in a beaded end, with the lobe of the jaws hooking behind the beaded end during crimping operation.

In order to facilitate a placement of the wraparound ring on the fitting, the links are spring-loaded to seek the closing position of the wraparound ring. Suitably, tube spring elements are positioned between neighboring links, or a leaf spring segment may be provided instead which is held on the outer peripheral surface of the wraparound ring and press-fitted onto the links.

According to another feature of the present invention, the links of the wraparound ring have a fitting-proximate side formed with projections or depressions for locking the links with respect to the fitting through positive engagement with parts of the fitting.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
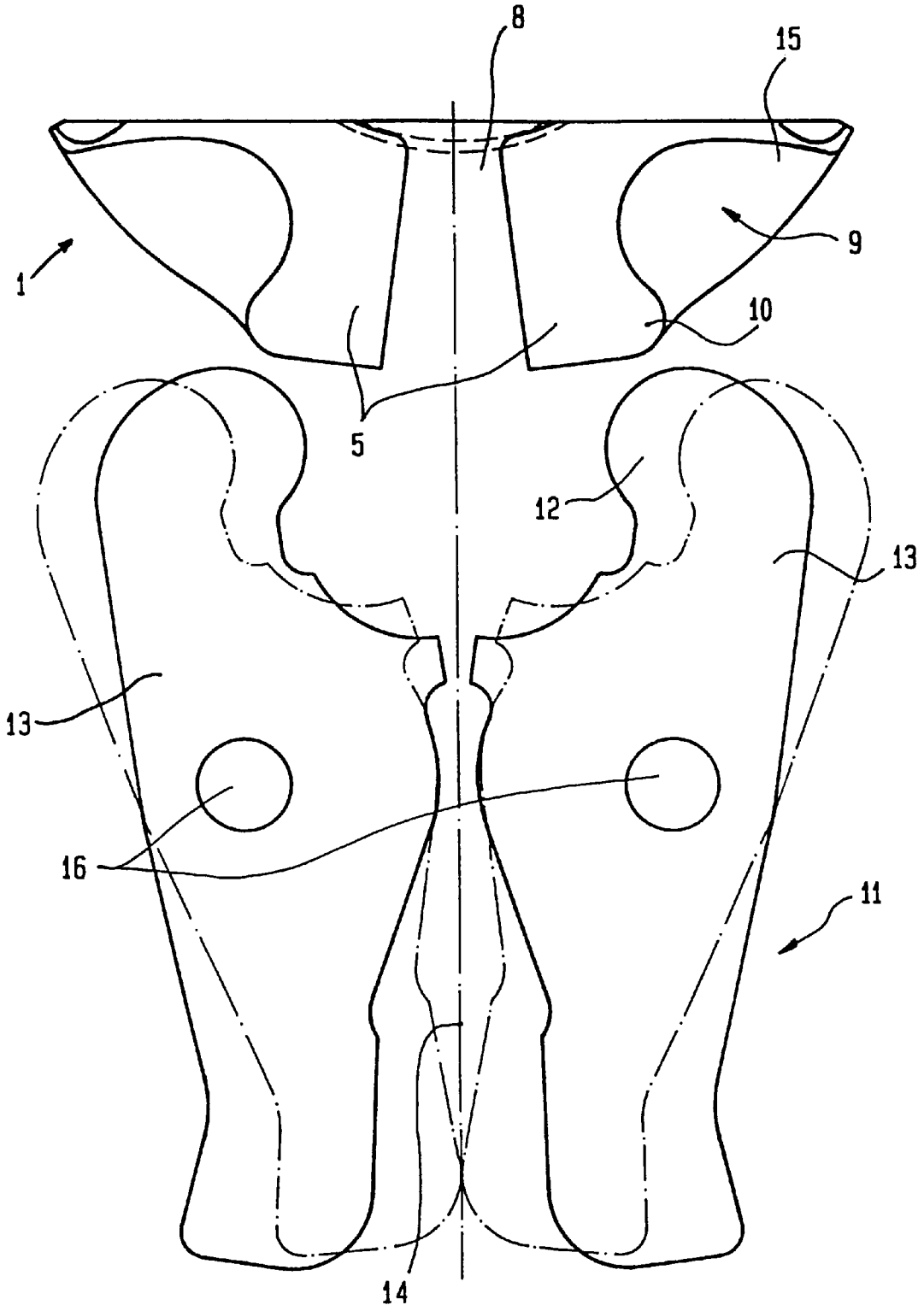
FIG. 1 is an elevational, schematic illustration of a press tool according to the present invention, showing in detail an electrohydraulically operated clamping device in conjunction with a wraparound ring, whereby the wraparound ring is shown only by way of the end links bounding the closing area.

Throughout all the Figures, same or corresponding elements are generally indicated by same reference numerals.

Figure 3:
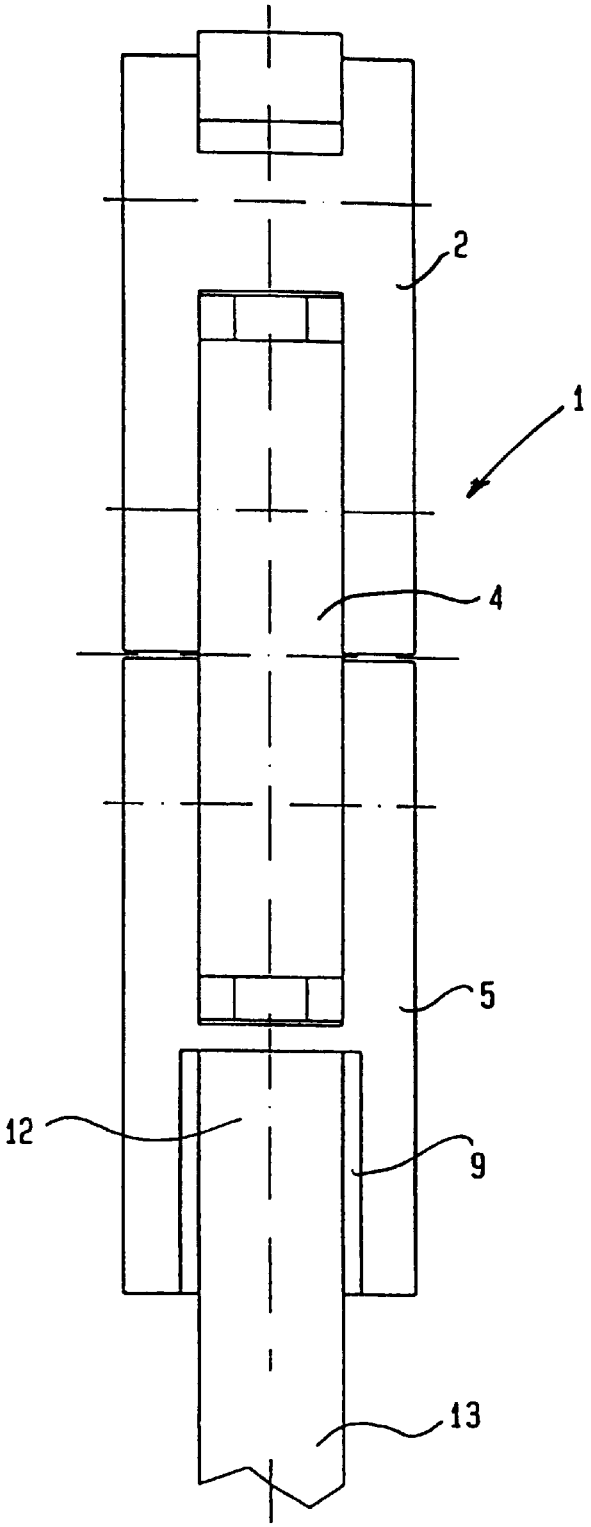
FIG. 3 is a side elevational view of the wraparound ring of FIG. 1 taken in the direction of arrow III in FIG. 2.

Turning now to the drawing, and in particular to FIG. 1, there is shown an elevational, schematic illustration of a press tool according to the present invention, including a wraparound ring, generally designated by reference numeral 1 which is formed by a plurality of interconnected links of which in FIG. 1 only the terminal or end links 5 are shown which bound a closing gap 8 of suitable size to allow the wraparound ring 1 to be placed over a fitting 7. As best seen in the exemplary embodiment of FIG. 4, the wraparound ring 1 occupies the opened position with respect to the fitting 7 and is formed by a plurality of links, including the afore-mentioned end links 5, links 2 which are articulated via hinge pins 6 to adapters (Seeger rings) 4 (cf. FIG. 3), and intermediate links 3 positioned between neighboring links 2.

The end links 5 are formed with pockets 9 which face outwards to establish an entry opening for cooperation with a machine-operated clamping device, generally designated by reference numeral 11. The clamping device 11 includes two jaws 13 which rotate about fixed pivots 16 with respect to a longitudinal center plane 14 between an idle position, shown in dashdot line in which the jaws 13 are fully opened, and an operative position, shown in continuous line, with the pivots 16 extending parallel to the center plane 14. The jaws 13 terminate in lobes 12 which are engageable in the pockets 9 of the end links 5 to press the end links 5 together and to thereby close the closing gap 8. Suitably, the pockets 9 are bounded on one side by a terminal bulb profile 10 of the end links 5 so that the lobes 12 of the jaws 13 hook behind the bulb profile 10 of the end links 5 when crimping the wraparound ring 1.

Figure 2:
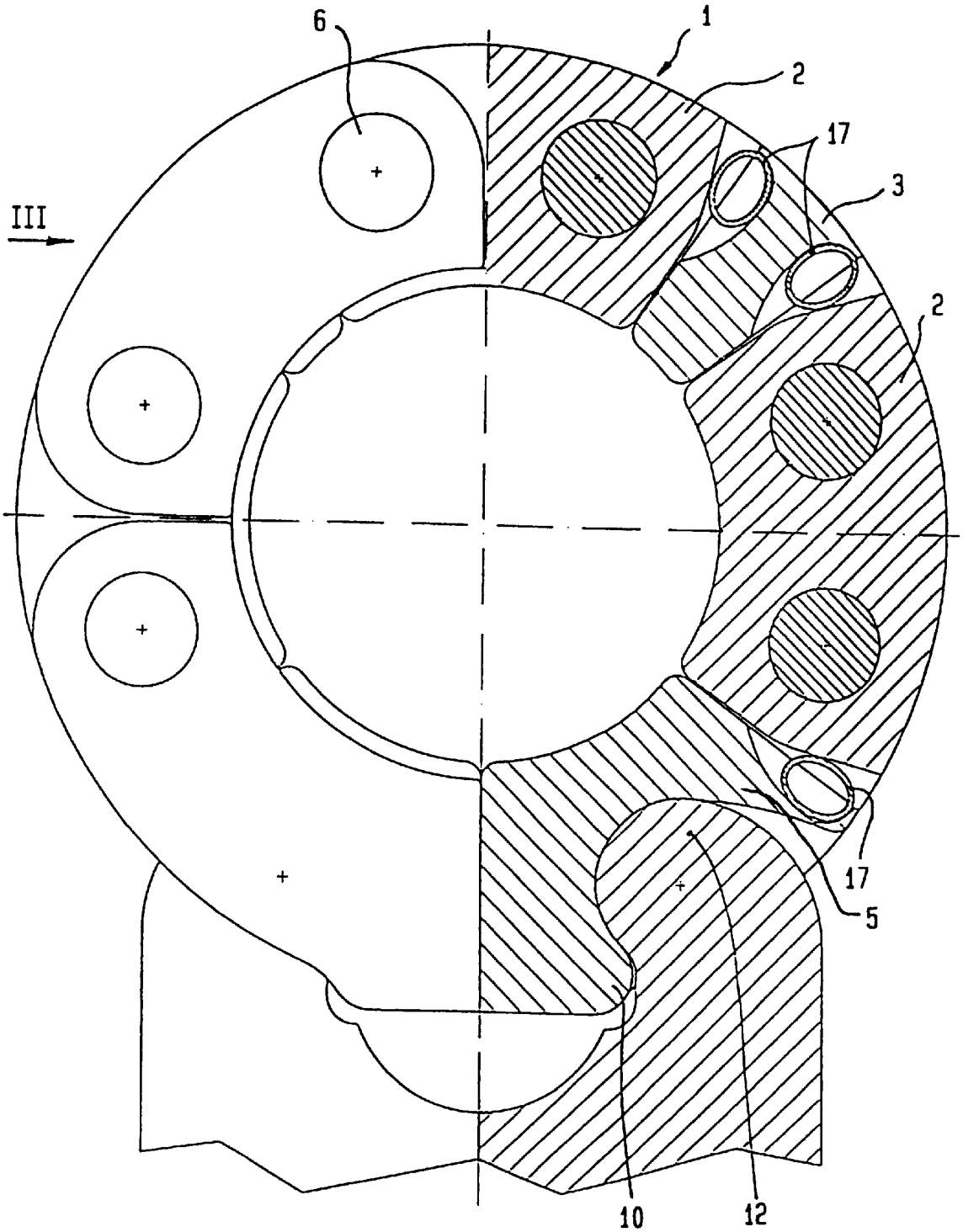
FIG. 2 shows the wraparound ring of FIG. 1 in a closed position, with the left half showing an elevational view of the connection between the clamping device and the wraparound ring, and the right half showing a sectional view thereof.

The lobes 12 extend towards the center plane 14 and complement the configuration of the pockets 9 so as to substantially fill out the pockets 9 in the operative position of the clamping device 11 for realizing a crimping of the wraparound ring 1, as shown in FIG. 2. The lobes 12 are of arcuate configuration and form with the complimentary boundary surfaces of the pockets 9 a positive fit so that the inner contour of the pockets 9 is also arc shaped, with the side faces 15 being smooth.

Figure 4:
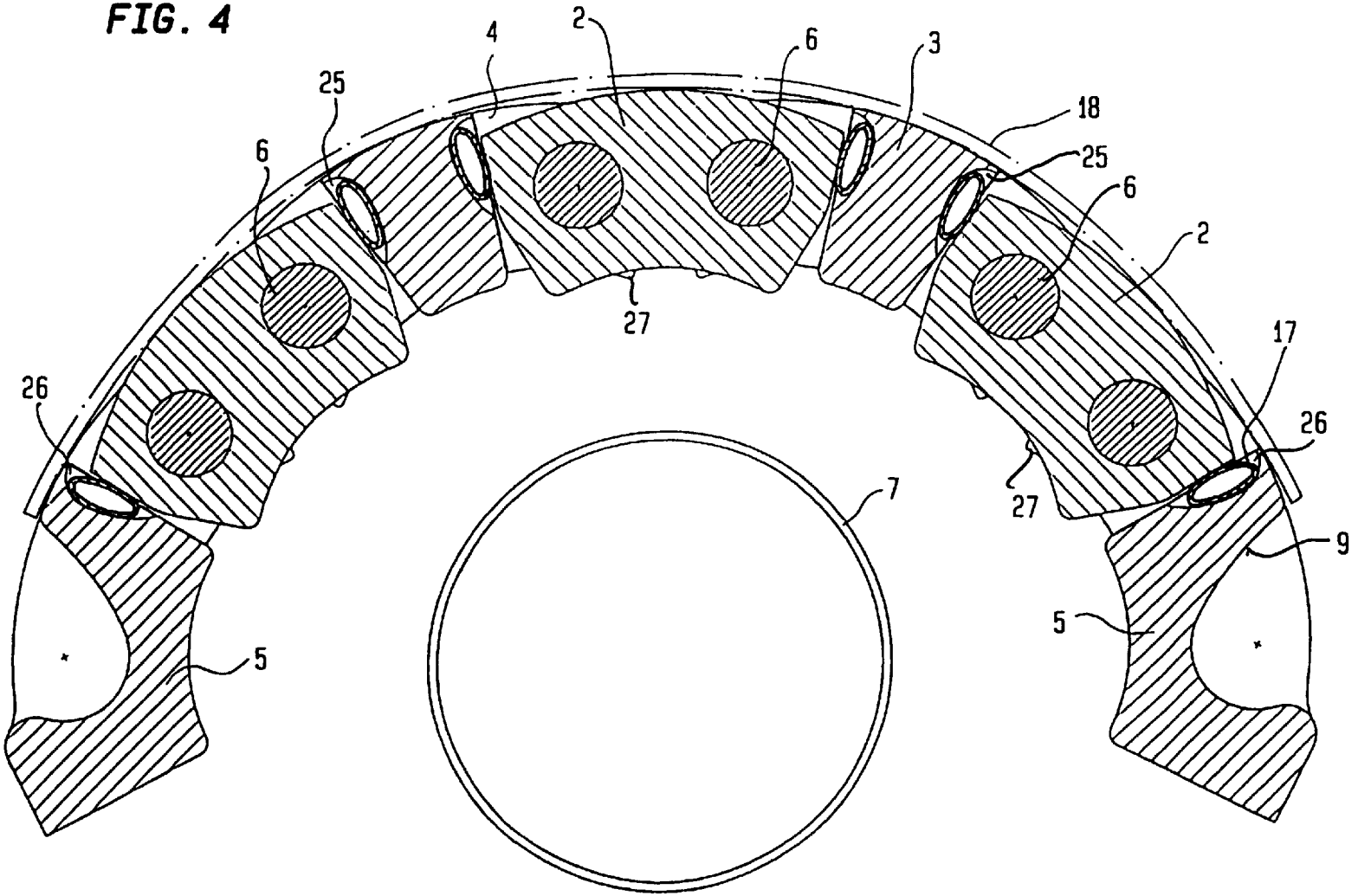
FIG. 4 is a sectional view of the wraparound ring of FIG. 1 in an opened position.

As further shown in FIGS. 2 and 4, spring elements 17 are positioned between neighboring links 2, 3, 5, for facilitating the placement of the wraparound ring 1 over the fitting 7 by so biasing the links 2, 3, 5 that they seek a closing of the ring 1. In the opened position of the wraparound ring 1, as shown in FIG. 4, the ring elements 17, e.g. tube springs, are significantly deformed, with each intermediate link 3 being formed on each side with a recess 25 for receiving a respective one of the spring elements 17, and with the end links 5 on their side adjacent the neighboring link 2 being formed with a recess 26 for receiving a respective one of the spring elements 17.

Instead of employing the spring elements 17, it is also possible to facilitate the attachment of the wraparound ring 1 to the fitting 7 by using a leaf spring 18 which, as indicated in dashdot line in FIG. 4, circumscribes a major portion of the outer peripheral surface of the wraparound ring 1.

As further shown in FIG. 4, the links 2 are formed interiorly on their fitting-proximate side with protrusions 27 for interaction with complementary components on the fitting 7 to thereby realize a positive engagement therewith. It is also possible to provide the links with depressions to realize the positive engagement with the fitting 7.

Persons skilled in the art will also understand that the wraparound ring may be modified in any suitable manner so long as the end links adjacent the closing gap are formed with pockets for engagement by the jaws of the clamping device. Crimped connections between fittings and pipe ends of any size can be effected by simply using appropriately sized wraparound rings.

Figure 5:
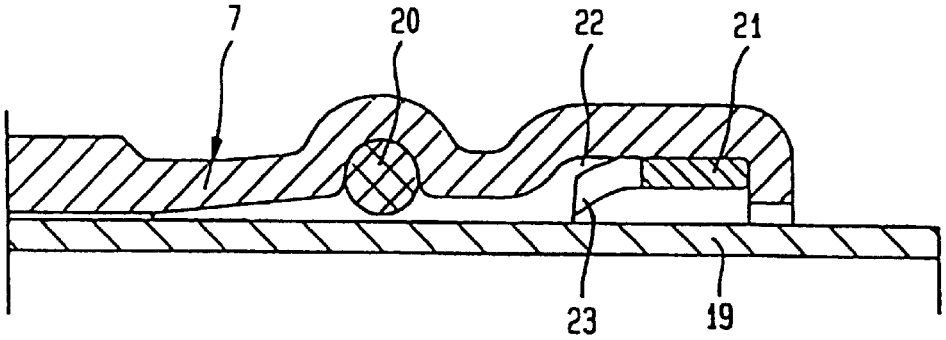
FIGS. 5 to 7 are sectional views of various stages for realizing a non-detachable connection between a fitting and a metal pipe.

Turning now to FIG. 5, there is shown a fragmentary, sectional view of the fitting 7, on enlarged scale, showing in detail the socket thereof for receiving the end of a metal pipe 19. The socket of the fitting 7 includes an anchoring groove for a sealing element 20 and a receiving groove 22 for accommodating a holding element 21 which may be positively secured to the inside of the socket of the fitting 7, or resiliently mounted. The holding element 21 may be formed by a ring, which is slotted in axial direction, and includes projections 23 which are pointed at angle towards the metal pipe 19.

Figure 6:
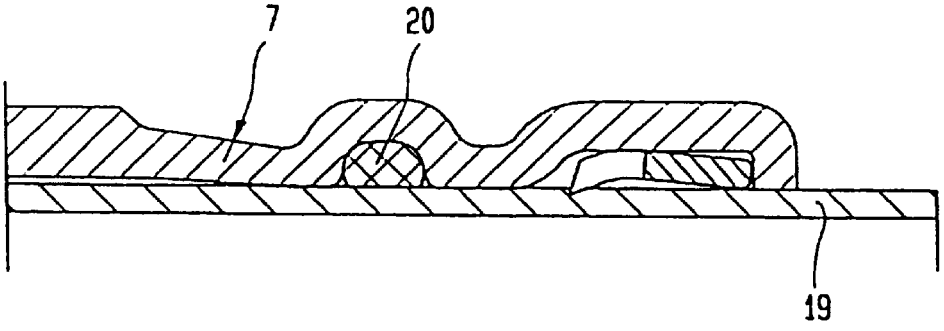
Figure 7:
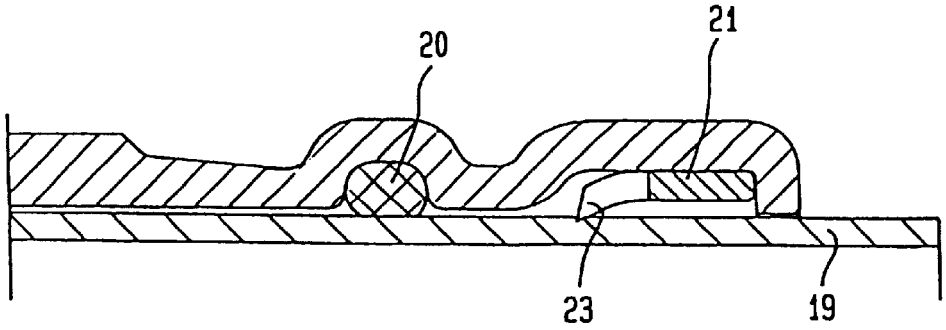

After placement of the wraparound ring 1 over the fitting 7 to occupy a position, indicated in FIG. 1, and engaging the lobes 12 of the clamping device 11 in the pockets 9 of the end links 5, the jaws 13 of the clamping device 11 are pressed together, thereby elastically deforming the sealing element 20 and forcing the projections 23 of the holding element 21 to dig into the material of the metal pipe 19, as shown in FIG. 6. The fitting 7 is now positively secured with respect to the end of the metal pipe 19. FIG. 6 shows the end of the crimping operation, with the crimping device 11 still being attached to the fitting 7. After removal of the crimping device 11, a slight recoil of the fitting parts is experienced, as shown in FIG. 7; However, during the slight recoil, the projection 23 of the holding element 21 remains entrenched in the material of the end of the metal pipe 19.

While the invention has been illustrated and described as embodied in a press tool for non-detachably connecting a fitting and an end portion of a metal pipe received in the fitting, it is not intended to be limited to the details shown since various modifications and structural changes may be made without departing in any way from the spirit of the present invention.

What is claimed is:

1. A press tool for non-detachably connecting through cold deformation a fitting and an end portion of a metal pipe received in a socket of the fitting, said press tool comprising:

a wraparound ring for placement over the socket of the fitting, said wraparound ring including a plurality of hinged links and being open at one closing area between two terminal links, said terminal links being formed with pockets to form grip points; and a machine-driven clamping device having grip ends for engagement in the pockets of the terminal links, said clamping device having a pair of jaws rotatable about pivots which extend parallel to one another in symmetry to a longitudinal center plane, said grip ends being formed in one piece with the jaws and formed as arched lobes pointing toward the center plane for engagement in the pockets, said pockets having an arched inner contour and smooth side surfaces, said terminal links adjacent the closing area each being configured with a terminal bulb profile to bound the arched inner contour of the pockets, with the lobes of the jaws hooking behind the bulb profile of the terminal links during crimping operation, wherein the socket of the fitting is formed with an inwardly facing groove for receiving at least one holding element which is so configured as to penetrate into the material of the end portion of the metal pipe during radial cold deformation.

2. The press tool of claim 1, and further comprising spring means interacting with the links and applying a force acting in closing position of the wraparound ring.

3. The press tool of claim 2 wherein the spring means includes tube spring elements positioned between neighboring links.

4. The press tool of claim 3 wherein the links have pockets for receiving the tube spring elements which partially jut out from the pockets.

5. The press tool of claim 2 wherein the spring means includes a leaf spring segment positioned outside on the wraparound ring and force-fitted onto the links.

6. The press tool of claim 1 wherein the links have a fitting-proximate side formed with projections or depressions for locking the links with respect to the fitting through positive engagement with parts of the fitting.

7. An arrangement for connecting two members nested within one another, comprising:

a wraparound ring placed around an outer one of the two members and including a plurality of links so joined to one another as to leave a distance between two opposite terminal links, each of said terminal links being formed with a pocket;

a clamping device having two jaws for engagement into the pockets of the terminal links for pressing together the terminal links of the wraparound ring, said jaws being formed with arched ends of a configuration complementing an inside configuration of the pockets in the terminal links, wherein the terminal links are formed with a bulb profile to bound the pockets, with the arched ends of the jaws hooking behind the bulb profile of the jaws when bringing together the terminal links of the wraparound ring by the clamping device, wherein the outer one of the two members is provided interiorly with a holding element which is so configured as to penetrate the material of the inner one of the two members when bringing together the terminal links of the wraparound ring by the clamping device.

8. The arrangement of claim 7 wherein the holding element has one part secured to the outer member and another part pointing toward the inner member.

9. The arrangement of claim 7, and further comprising spring means for so loading the wraparound ring that the terminal links seek their closing position.

10. The arrangement of claim 9 wherein the spring means includes tube spring elements positioned between neighboring links.

11. The arrangement of claim 9 wherein the spring means includes a leaf spring segment positioned outside of the wraparound ring and force-fitted onto the links.

* * * * *